US005644892A

United States Patent [19]

Smythe, Jr.

[11] Patent Number: 5,644,892

[45] Date of Patent: Jul. 8, 1997

[54] PRE-FABRICATED 3-WAY INSIDE DRYWALL CORNER

[75] Inventor: Timothy D. Smythe, Jr., Waikoloa, Hi.

[73] Assignee: Drywall Systems International Inc., Woodinville, Wash.

[21] Appl. No.: 505,797

[22] Filed: Jul. 21, 1995

[51] Int. Cl.[6] ..... E04B 2/00

[52] U.S. Cl. ..... 52/745.05; 52/287.1; 52/254

[58] Field of Search ..... 52/748.11, 254, 52/255, 287.1, 288.1, 256, 257, 745.13, 745.05, 741.1

[56] References Cited

U.S. PATENT DOCUMENTS

| | | | |
|---|---|---|---|
| 3,350,825 | 11/1967 | Rillo | 52/287.1 |
| 3,754,363 | 8/1973 | Schneller et al. . | |
| 4,722,153 | 2/1988 | Hardy | 52/255 |
| 4,763,455 | 8/1988 | Schneller . | |
| 4,835,925 | 6/1989 | Hoffmann, Sr. . | |
| 4,876,837 | 10/1989 | Kelly et al. . | |
| 5,086,598 | 2/1992 | Weldy | 52/288 |
| 5,131,198 | 7/1992 | Ritchie et al. . | |
| 5,505,032 | 4/1996 | Wasserman et al. | 52/254 X |

*Primary Examiner*—Carl D. Friedman
*Assistant Examiner*—Timothy B. Kang
*Attorney, Agent, or Firm*—Clifford Kraft

[57] ABSTRACT

A pre-fabricated 3-way inside drywall corner with three tapered flanges to be placed in the pointed 3-way corners created where sheets of hung drywall are joined to form two walls and a ceiling. This pre-fabricated corner can be paper, metal, or other suitable material. It allows a drywall worker to string tape by starting the tape a few inches away from a corner and running to the next corner, ending a few inches away from the second corner. The worker thus does not have to gauge exactly where to cut the tape to mate into the corners. Also, the effect of tape slip while stringing becomes unimportant. After tape and drywall mud is dry, before the finishing step, the pre-fabricated corners are placed in every corner of a room, held in place by drywall mud. A drywall worker needs only to put a small amount of topping mud on the flanges and then "kill" the corner with a 4–6 inch knife. This is done by smoothing the topping mud down the taper of the flange to form a flat, flush surface with the hung wall or ceiling board. The pre-fabricated drywall corner allows the creation of perfect 3-way corners by professionals and relatively inexperienced persons with a considerable time savings.

14 Claims, 6 Drawing Sheets

PRE-FABRICATED 3-WAY INSIDE DRYWALL CORNER

BACKGROUND

1. Field of the Invention

This invention relates generally to the field of drywall construction and more particularly to pre-fabricated interior 3-way corners for completion of drywall installation in construction.

2. Description of the Related Art

The use of gypsum drywall board in modern construction is well known. Manufactured drywall sheets are nailed to studs to form interior walls and ceilings. Before these sheets can be painted or textured, the joints must be taped and sealed with joint sealing compound (drywall mud).

In some special cases, metal beads or seams are used, as well as metal nailed corners. U.S. Pat. No. 5,086,598 is an example of extruded plastic strips and corners which are nailed. In U.S. Pat. No. 5,086,598 a system of raised members is nailed into place. This is mainly used for exterior corners. However, the bulk of finished drywall work requires taping with paper and the application of drywall mud. All finished surfaces and corners must end up completely smooth and flush. Raised surfaces or bumps, as well as imperfections, are not allowed. Drywall workers spend considerable work time to accomplish this. The dry taped, mudded surface is finished and becomes the final surface that receives paint or texture.

A professional drywall worker commonly tapes (strings) all interior seams with a tool known in the trade as a "bazooka". The bazooka dispenses both drywall tape and mud at the same time. Stringing straight seams in the center of walls and ceilings with a bazooka is relatively easy; however, stringing joints where walls or walls and ceilings come together is considerably more difficult. The most difficult, time-consuming, and frustrating task is stringing the pointed, 3-way corners where two walls and a ceiling come together. It is to this type of corner that the present invention relates and finds great utility.

To string an interior wall-ceiling seam with two 3-way corners, the worker starts the tape at one pointed corner of the room and works along the ceiling toward the other pointed corner. As the tape and mud strings out of the bazooka, the tape has a tendency to slip in the direction of the pull (away from the first corner). Thus, even though the tape was started in the first corner, by the time the worker reaches the second corner, the tape has slipped away from the first corner by up to an inch in some cases. As the worker approaches the second corner, there is no way to pull the bazooka completely into the second corner. This forces the worker to cut the tape away from the corner guessing at the correct length by experience. The tape is usually either cut short or long in the second corner, even by experienced drywall workers. The slippage of the tape away from the first corner, and the over or under cut of the tape in the second corner, make it difficult to achieve perfectly finished taped 3-way corners, and requires recutting and patching by hand.

Once the tape is strung, the worker must "roll" and "glaze" to pre-finish the taped seams and angles (corners) to press the tape into place and remove excess mud. A roller is first rolled along all tapes to firmly seat the tape into position. Then, a glazer is run along the tape to leave the mud as a thin uniform film. When the worker reaches the 3-way corner, neither the roller or glazer will fit into the corner. In addition, the worker finds that the tape usually is too long or short in the corner for the reasons already mentioned. The worker must first fix the tape length, and then attempt to glaze by hand using a wide knife blade. This step in the corners is very slow and extremely frustrating. The result must be a perfectly clean and glazed 3-way corner, something difficult to achieve.

Once the tape and mud has dried (usually the next day), the professional taper will coat the angles with topping mud using a glazer and angle box. Again, as the worker coats the tape, the mud will accumulate into the 3-way corners. This mud needs to be "starred" or pulled different directions with a 4 to 6 inch knife. Again the problems of producing a perfect 3-way finished corner arise. This time they are more acute since this is the last step in the process, and the result must be perfect. Depending on the finish of the walls (texture, orange peel, smooth, etc.), this process may need to be repeated a few times. With as many as seventy 3-way corners in a typical 2000 sq. foot house, the amount of hours spent processing 3-way corners becomes extremely large.

While the prior art is replete with devices, corner beads, re-enforcement members, etc. to form 2-way joints, there is virtually no notice of any method or apparatus to ease the work and frustration of un-beaded, un-nailed, flat 3-way corners. Since these corners are prevalent in almost all residential construction and much commercial construction, what is badly needed in the art is a method and apparatus that allows easy application of tape and mud to 3-way corners with the bazooka; easy rolling and glazing into the corners; and easy application of topping mud and finishing these same corners. The savings in work hours would be immense. Since the frustration of finishing so many corners would be removed, the professional worker could spend more time on more critical parts of the job and save time and money by completing the job faster with higher quality.

SUMMARY OF THE INVENTION

The present invention relates to solving the 3-way corner problem once and for all for taping, rolling, glazing, and finish steps. The present invention comprises a pre-fabricated corner and a method of using it. The pre-fabricated corner piece is capable of being quickly fitted into the 3-way corners of a room after drywall tape is dry and finishing has begun. This corner piece has three flanges that line up with the two walls and the ceiling sheets. During the stringing step, the worker does not need to start the tape exactly at the corner, but rather several inches (2–6 inches) from the corner since the pre-fabricated corner will be later installed. At the second corner of the bazooka run, the worker also ends the tape several inches from the corner rather than trying to hit the corner exactly. Thus the frustration and error of tape sliding becomes inconsequential, and there is no corner fitting of tape.

When rolling and glazing, with the tape stopped back from the corner approximately 2–6 inches, the glazer itself will clean the excess mud by sliding past the end of the tape. Since the tape has been ended away from the corner, there is no problem fitting the glazer into the corner. Likewise, when coating the corners in the finishing step (after the tape is dry), the worker will be able to stop the glazer and angle box before the corners totally eliminating the starring process throughout the building. This saves an incredible amount of time.

Once the angles are coated to the desired finish, the worker then only has to go from one corner to the next installing the pre-fabricated 3-way inside corner piece. This operation takes no more than one minute per corner. To install the present invention in a corner, the worker applies mud with a wide blade knife on the three surfaces. The pre-fabricated corner is then placed by hand in the corner. It adheres immediately to the wet mud. The worker then quickly runs the blade over the edges to apply a small amount of mud.

When the corners are installed everywhere, the worker simply goes back and "kills" the tapered edge of the flanges with a 4–6 inch knife. This is done by putting a small amount of topping mud on the flange and wiping the tapered edge of the flange with the knife to create a clean flush surface into the rest of the wall or ceiling board. This takes no longer than one minute per corner. The use of the present invention by an experienced or even amateur worker allows perfect 3-way finished corners in a fraction of the time and cost required by previous methods.

BRIEF DESCRIPTION OF THE DRAWINGS

For a more complete understanding of this invention, reference should now be made to the embodiments illustrated in greater detail in the accompanying drawings and described below by way of examples of the invention.

It should be understood, of course, that the invention is not necessarily limited to the particular embodiments illustrated herein.

DESCRIPTION OF PREFERRED EMBODIMENTS

Figure 1:
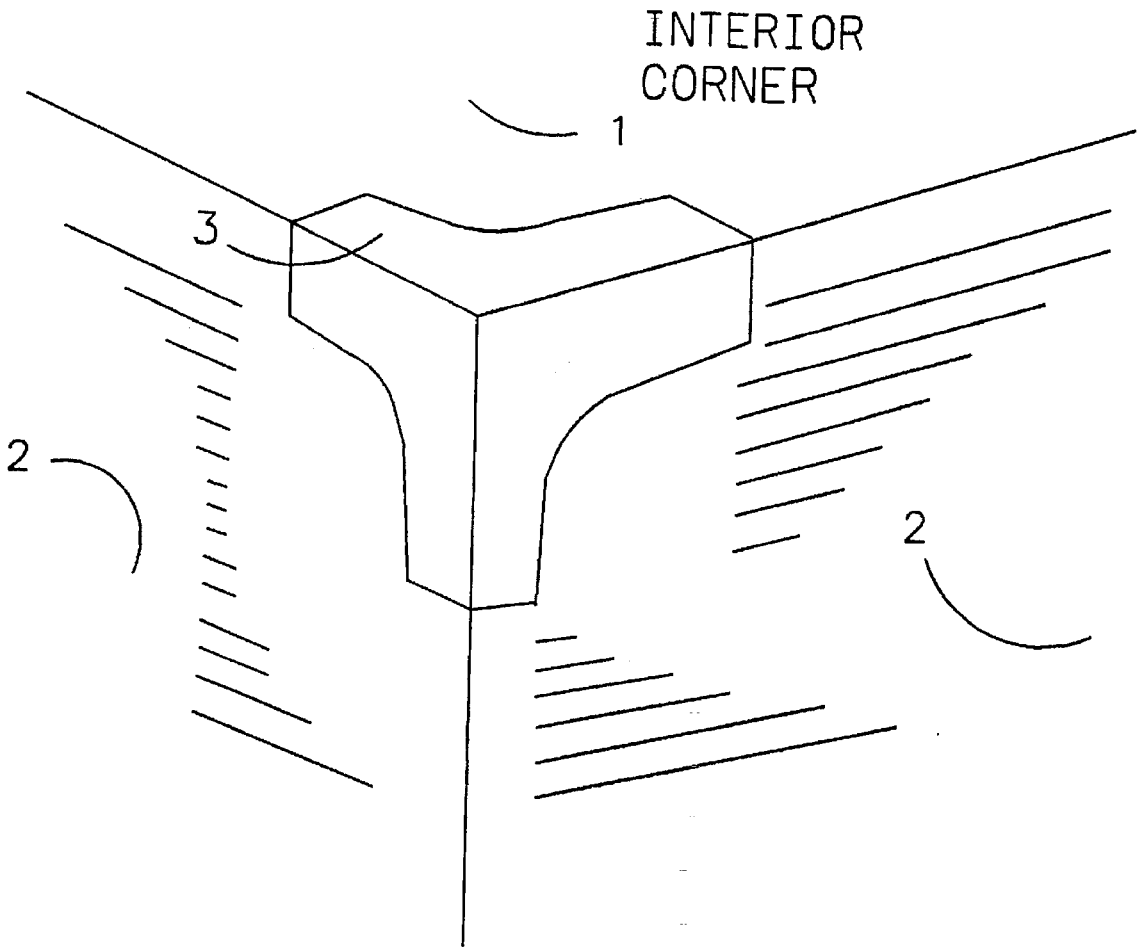
FIG. 1 shows the use of an embodiment of the present invention in an interior 3-way corner.

The use of the present invention can be seen from FIG. 1. Here the prefabricated 3-way corner 3 is held in the pointed interior corner with drywall mud. The three-way corner is formed 5 from three hung sheets of drywall material that form the walls 2 and the ceiling 1.

Drywall tape is run from wall to wall and stopped a few inches from the corners. This tape is strung from a bazooka and rolled and glazed while wet. The interior 3-way corners formed by the drywall sheets are left untaped. The end of the tape is smoothed with the glazer. Later, when the original mud has dried coating proceeds in the normal fashion, except the corners are ignored. Then, the pre-fabricated corner 3 is stuck into the corner by applying a small amount of mud to the three surfaces with a wide blade knife. Finally, the edges of the pre-fabricated corners are killed with a knife to form a perfect mate with the wall or ceiling board.

Figure 2:
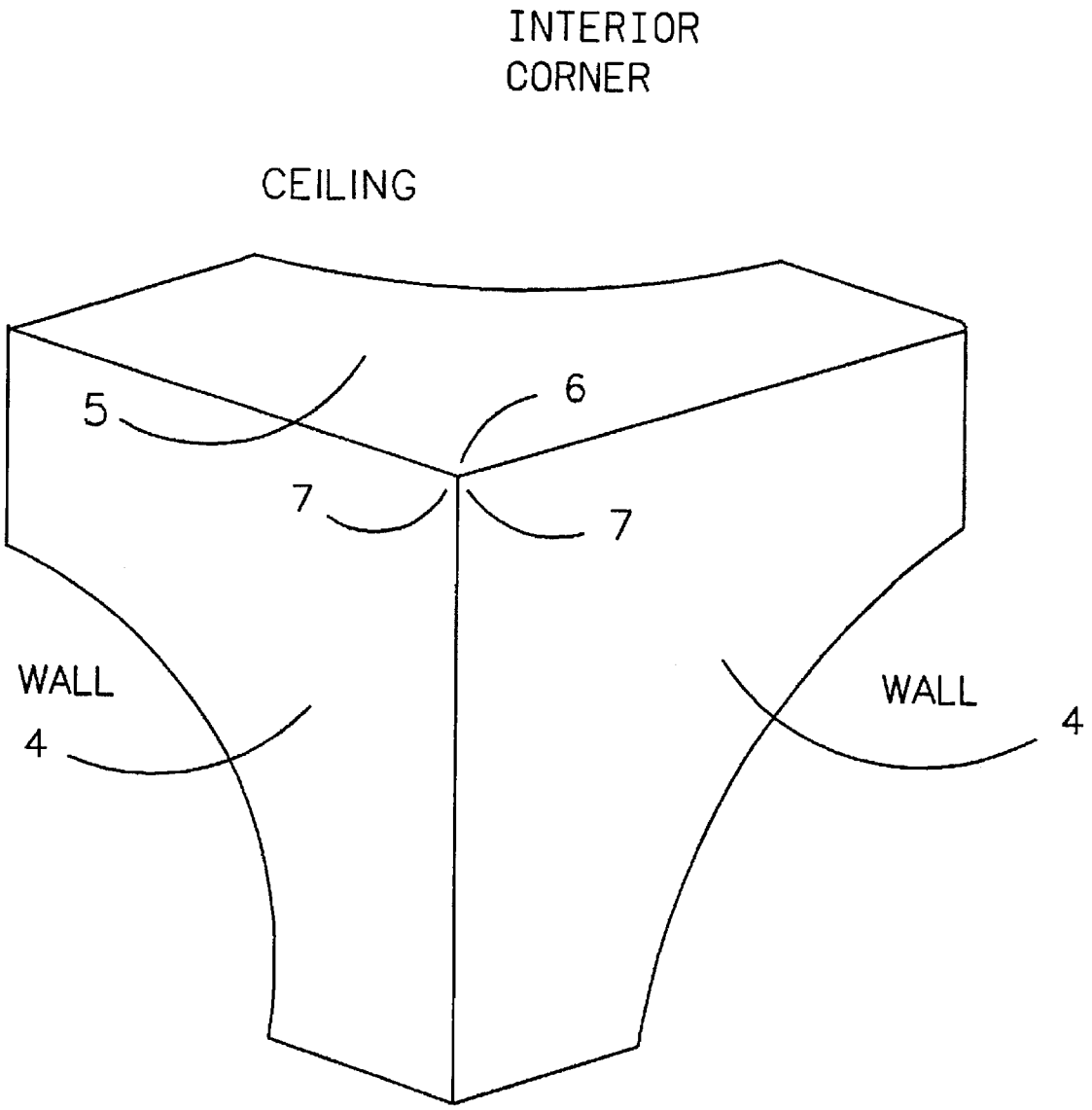
FIG. 2 is a three-dimensional view of an embodiment of the present invention showing the flanges and corner angles.

The structure of the preferred embodiment can be seen in FIG. 2. There is a central point forming three angles: two wall angles 7, and one ceiling angle 6. There are three flat flanges extending onto the two walls 4 and ceiling 5. The edges of each flange may taper to meet the wall boards flush. The flanges can be elongated as rectangles or triangles, or they can be rounded out as shown in FIG. 2.

The pre-fabricated corner 3 is preferably made from paper; however a variety of other materials can be used such as plastic, metal or any material lending itself to pre-fabricated shaping 5 and wetting by drywall mud. While wetting is highly desirable for forming a perfect finish, it is not essential. Various thickness of material can be used from under 2 or 3 mils to well over 25 mils. The preferred thickness is that of a paper plate. The only requirement on thickness is that the pre-fabricated corner must keep its shape when put up, and must be strong enough to ship and handle. The surface of the material should resemble that of the paper stringing tape and should receive drywall mud. Paper wets nicely and holds the mud as does tape and various other materials. While metal can be used, it has disadvantages of being heavier and possibly requiring nailing. Even though the present invention could be nailed, no nails are necessary. In fact, nails are very undesirable because they are hard to put into 3-way corners. Also, all metal, including a nail, has a tendency to rust, no matter what its finish. Therefore, by avoiding the need for nails, the present invention represents a tremendous time and cost savings over previous methods. It is possible to manufacture the present invention with various coatings or finishes applied, or as simply a plain surface like that of drywall tape. Plastic can certainly be used in the present invention, but it does not wet as well as paper and hence, has more difficulty holding mud. It is also stiffer and more difficult to fit into a 3-way corner.

The angles 6 and 7 are critical in making a tight fit. Angle 6 is a wall-wall angle; angles 7 are ceiling-wall angles. It is possible to produce the present invention with three 90 degree angles; however, slight variations on 90 degrees have been found to be preferable. For the standard orthogonal corner found in a typical residence, angles near 91 degrees for ceiling-wall angles 7 and near 93–94 degrees for the wall-wall angle 6 have been found preferable. It should be noted that the present invention can be pre-fabricated for walls that meet at any angles. Common angles found in the field run between 30 degrees and 140 degrees including 71–72 degrees and 107–109 degrees for a four inch rise every twelve inches and 45 degrees and 135 degrees for a twelve inch rise every twelve inches. If one of the walls (or ceiling) runs at a different angle, it is possible to cut between the flanges with scissors to form a different angle. In addition, the present invention can be pre-fabricated for other common angles encountered in the field. Since the orthogonal 3-way corner is the most common, the present invention finds its greatest utility in addressing these types of corners.

While FIG. 2 shows the three flanges 4 and 5 meeting at a distinct corner point, it is also possible to use a rounded corner of arbitrary radius of curvature. Most residential construction requires flat, pointed 3-way corners. In any case, the center of the flange forms a flat surface of uniform thickness which can then taper toward the wall and ceiling edges so that the drywall worker can "kill" the edges with topping mud to get a perfectly flush monolithic finished corner. If a very thin embodiment of the present invention is used, tapering may not be necessary. In fact, tapering is optional in all embodiments.

Figure 3:
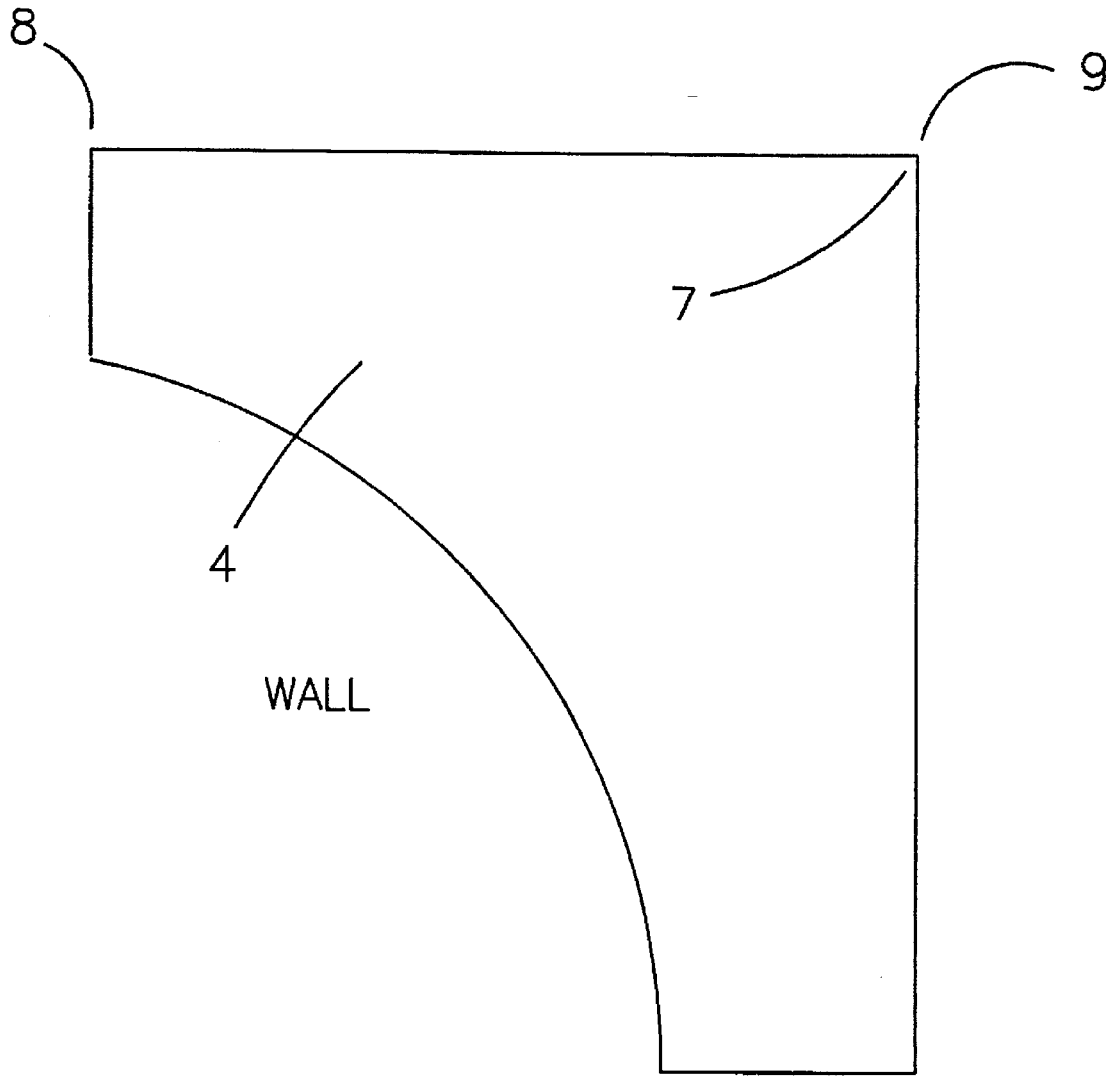
FIG. 3 is side view of the embodiment of FIG. 2.

FIG. 3 shows a side view of the embodiment of FIG. 2. Here the angle 7 is clearly seen along with the length of the flange which extends from point 8 to point 9. This length is on the order of several inches with 6 to 8 inches being preferred. However, the flanges can be as short as 2 inches or as long as 15 inches.

Figure 4:
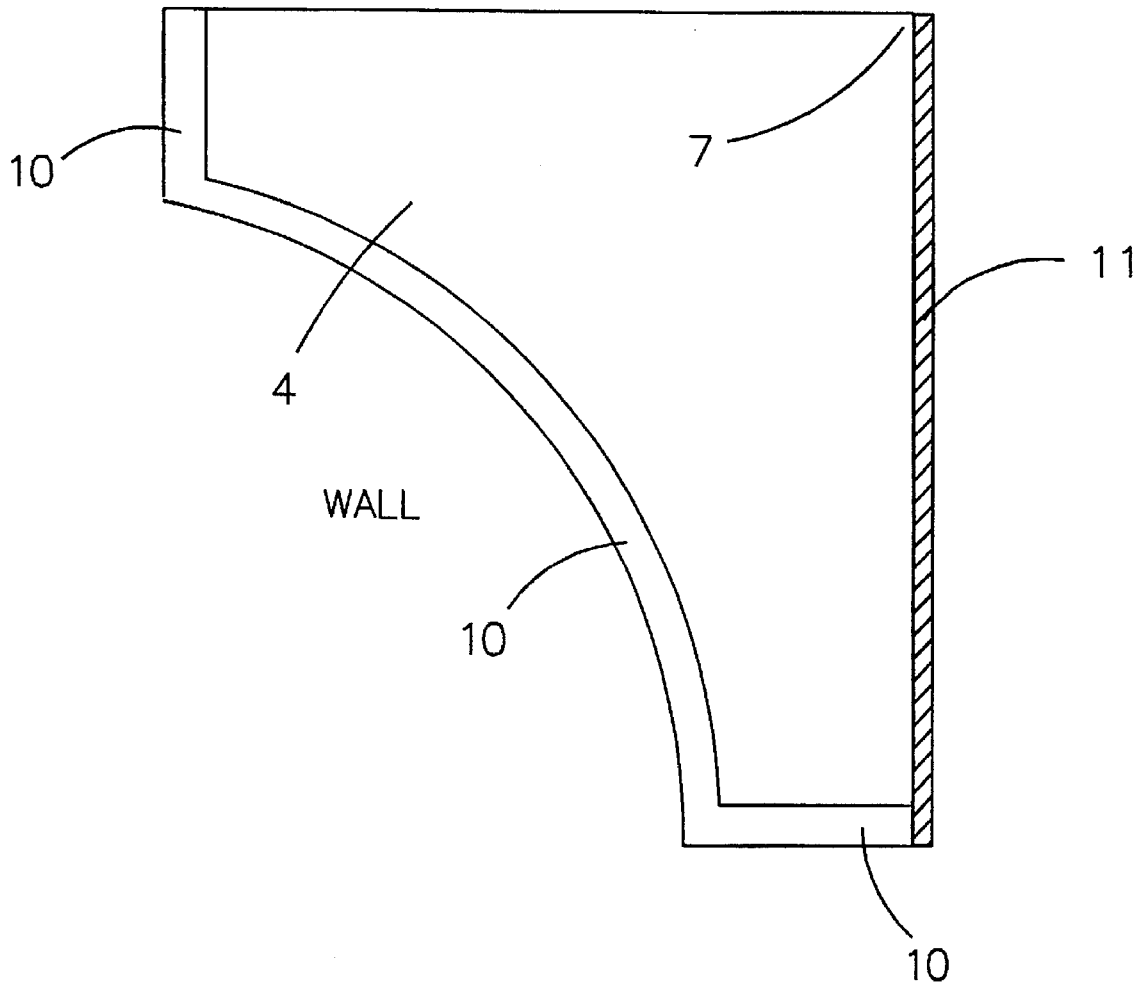
FIG. 4 shows an embodiment of the tapered edges of the present invention.

FIG. 4 shows the cross section of the flange 11 in the thicker portion and the edge taper 10. All edges can be tapered to meet the hung wall board flush; however, the taper is optional. The present invention can be fabricated with uniform thickness material that contains no taper. The taper 10 is however very desirable to the worker as an aid in "killing" the edges with mud to produce a perfect wall, and hence is preferred. The taper 10 can be local near the flange edge or it can extend from the flange edge to the flange center.

Figure 5:
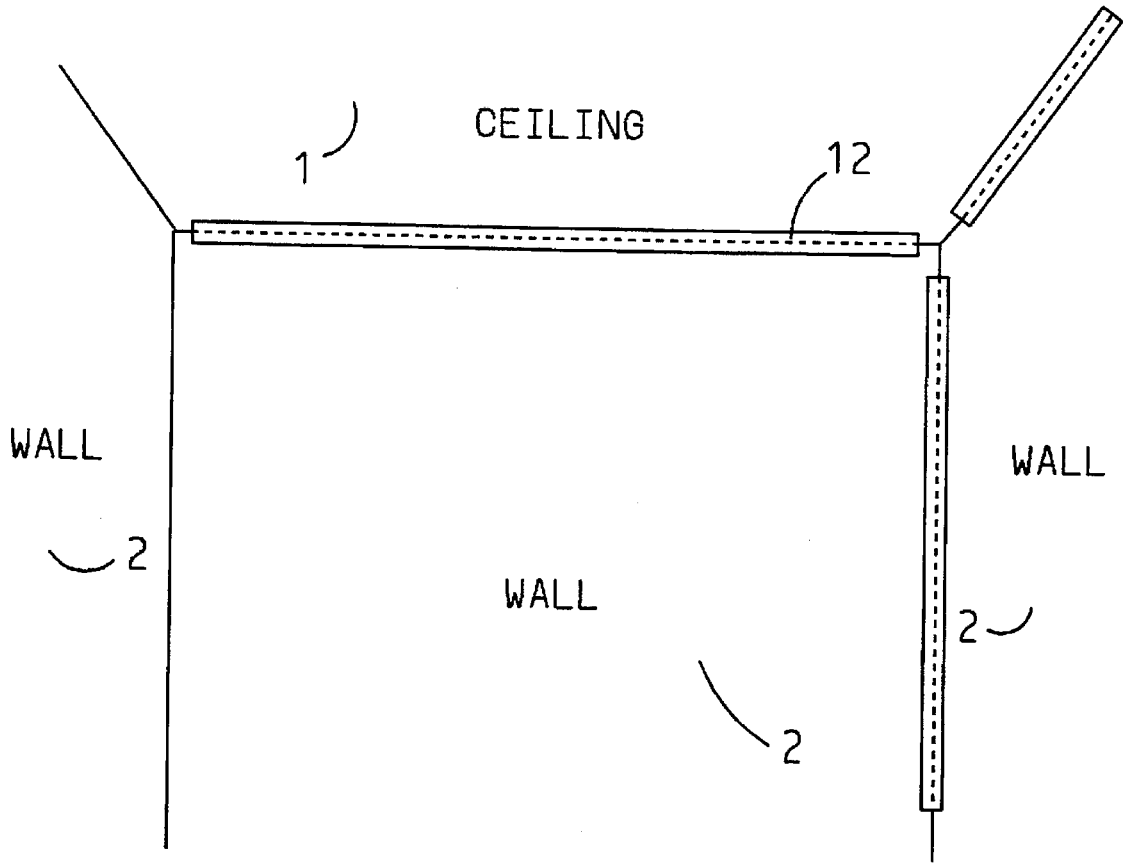
FIG. 5 shows how tape is strung using the method of the present invention.
Figure 6:
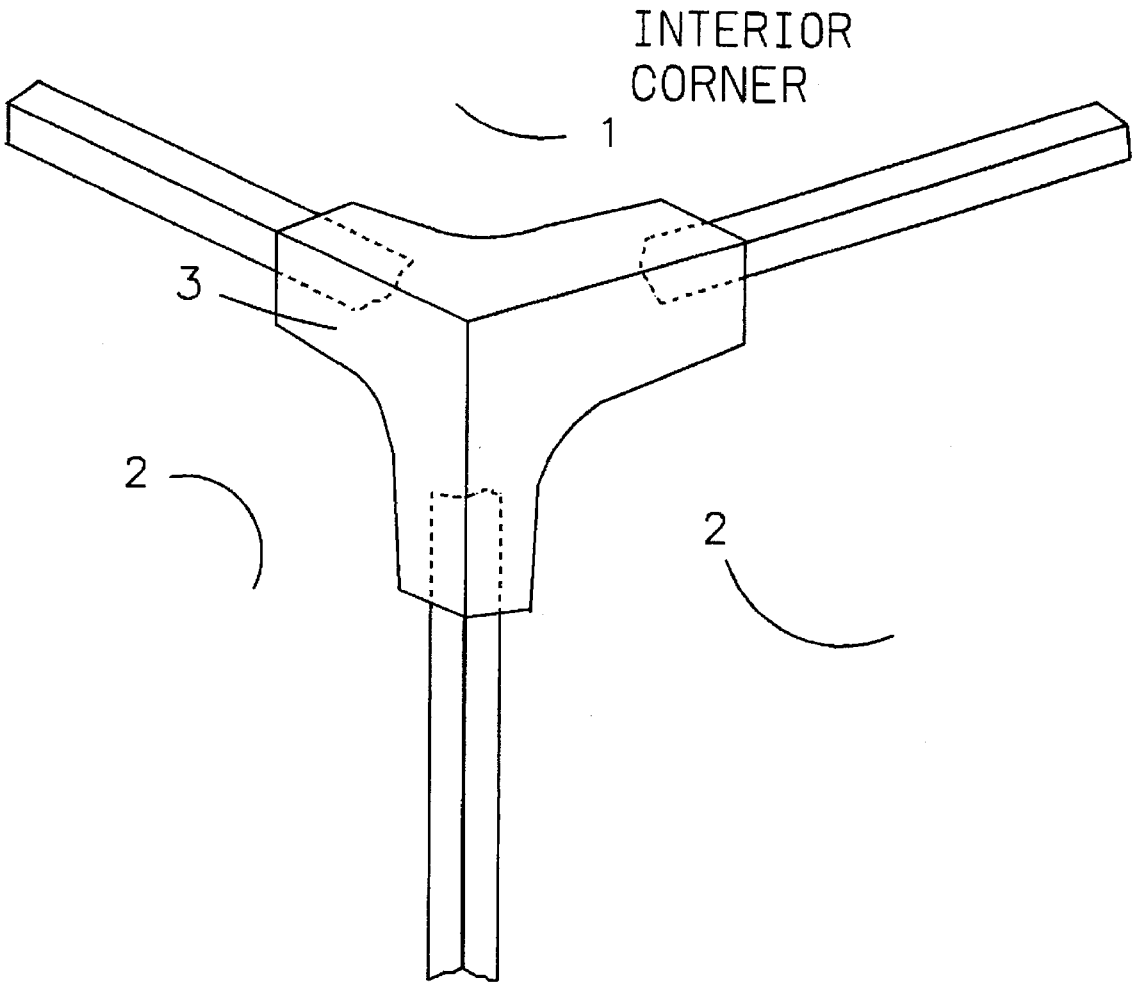
FIG. 6 shows how the corner piece of the present invention is placed in a 3-way corner on top of tape.

FIG. 5 shows tape strung between two interior three way corners as a first step in the method of the current invention. The tape 12 is strung in the conventional manner from one interior corner to another along the wallboard 2. The tape is ended from 2 to 6 inches from the corners. FIG. 6 shows how the preformed interior corner of the present invention is located in the corner. The corner piece 3 is placed on top of the strung tape 12.

After drywall is hung, the worker begins taping a wall-ceiling seam at a corner with the bazooka. The bazooka strings paper tape and mud at the same time. With the present invention, he simply starts the tape within a few inches from the first corner. The exact distance is unimportant. As taping progresses toward a second corner a fairly large amount of tape slip can be tolerated without any concern or correction. As the worker approaches the second corner, there is no need to gauge or measure or guess exactly where to cut the tape. The tape is simply ended within a few inches from the corner. Rolling and glazing proceeds as normal with the mud simply being thinned out toward the corner with the glazer. No attempt is made at this point to finish the corner. Since the tape ends approximately 5 inches from the corner, the glazer itself will quickly clear the excess mud. This alone eliminates a major job—clearing mud from the corner.

After the mud has dried (usually the next day), the worker coats the tape in the normal way with the glazer and angle box. When finished coating, he sticks the pre-fabricated 3-way corners of the present invention into each interior corner of the room (or multiple rooms) with a small amount of mud spread on the three surfaces forming the corner with a wide blade knife or other tool. This is very fast (approximately 1 minute or less per corner). The worker then quickly smoothes the edges of the pre-fabricated corner with the blade.

Since the worker was able to coat with only the angle box and could stop before reaching into the corners, the starring process has been eliminated altogether. The elimination of the starring process represents the most significant time savings of the present method. The entire starring process has been replaced with the use of the present invention.

Once all the corners are installed, the worker goes back and "kills" the edges of the flanges with a wide blade knife. This should take no longer than 1 minute per corner. The result is a perfect interior 3-way corner in a very short time.

It is to be understood that the above-described arrangements are merely illustrative of the application of the principles of the invention, and that other arrangements may be devised by those skilled in the art without departing from the spirit and scope of the invention.

What is claimed is:

1. A method of finishing interior drywall corners comprising the steps of:

applying tape along a joint formed by the intersection of two wallboard surfaces starting said tape 2–6 inches from a first interior 3-way corner;

ending said tape 2–6 inches from a second interior 3-way corner;

placing a prefabricated 3-way drywall corner piece with flanges in at least one of said interior 3-way corners, whereby the flanges of said prefabricated corner are placed on top of the ends of said tape;

killing edges of said flanges with drywall mud using a flat tool to produce a flush surface with said drywall surfaces.

2. The method of claim 1 further comprising the step of rolling and glazing said tape after applying it.

3. The method of claim 1 wherein said flat tool is a 4–6 inch knife.

4. The method of claim 1 wherein said prefabricated corner piece is paper.

5. A method of finishing interior drywall corners comprising the steps of:

taping a seam formed by the intersection of two wallboard surfaces with paper tape and drywall mud starting said tape 2 to 6 inches from a first interior 3-way corner;

ending said tape 2 to 6 inches from a second interior 3-way corner;

rolling and glazing said tape, smoothing excess mud with a glazer;

allowing said mud and tape to dry;

attaching a prefabricated drywall corner piece with flanges in at least one of said interior 3-way corners, said flanges covering said tape;

killing edges of said flanges with mud and a flat tool to produce a flush surface with said wallboard surfaces.

6. The method of claim 5 wherein said flat tool is a 4–6 inch knife.

7. The method of claim 5 wherein said prefabricated drywall corner piece is paper.

8. The method of claim 7 further comprising cutting said prefabricated drywall corner piece along a seam to fit a non-orthogonal corner.

9. A method of finishing interior drywall corners comprising:

taping a seam formed by the intersection of two wallboard surfaces with paper tape and drywall mud starting said tape 2 to 6 inches from a first interior 3-way corner;

ending said tape 2 to 6 inches from a second interior 3-way corner;

attaching a prefabricated drywall corner piece into at least one of said corners over said tape, said prefabricated drywall corner piece comprising:

a center with three flat flanges with edges, said flanges extending laterally at angles near 90 degrees relative to one another, whereby said flanges join to form a 3-way interior corner;

killing the edges of said flanges with mud and a flat tool to produce a flush surface with said wallboard surfaces.

10. The method of claim 9 further comprising rolling and glazing said tape.

11. The method of claim 9 further comprising allowing said tape to dry before attaching said prefabricated drywall corner.

12. The method of claim 9 wherein said prefabricated drywall corner is paper.

13. The method of claim 9 wherein the angles of said prefabricated drywall corner are 90 degrees.

14. The method of claim 9 further comprising cutting said prefabricated drywall corner piece along a seam to fit a non-orthogonal corner.

* * * * *